US005577284A

United States Patent [19]

Muller

[11] Patent Number: 5,577,284

[45] Date of Patent: Nov. 26, 1996

[54] CHANNEL BRIDGE

[76] Inventor: Jean Muller, 13 rue Victor Hugo, 92150 Suresnes, France

[21] Appl. No.: 199,767

[22] Filed: Feb. 22, 1994

[51] Int. Cl.[6] ..... E01D 19/02

[52] U.S. Cl. ..... 14/73; 52/223.6

[58] Field of Search ..... 14/73, 78, 77.1; 52/223.6, 223.7, 174, 745.2

[56] References Cited

U.S. PATENT DOCUMENTS

| | | | |
|---|---|---|---|
| 890,769 | 6/1908 | Hewett . | |
| 3,295,276 | 1/1967 | Rene | 52/174 |
| 3,570,207 | 3/1971 | Launay | 52/745 |
| 3,794,433 | 2/1974 | Schupack | 404/1 |
| 3,882,564 | 5/1975 | Muller | 14/77 |
| 4,601,079 | 7/1986 | Corica | 14/2.4 |
| 4,604,841 | 8/1986 | Barnoff et al. | 14/73 X |
| 4,625,354 | 12/1985 | Richard | 14/73 |
| 4,710,994 | 12/1987 | Kishida et al. | 14/1 |
| 4,825,492 | 5/1989 | Zehavi et al. | 14/1 |
| 4,972,537 | 11/1990 | Slaw, Sr. | 14/1 |
| 5,097,558 | 3/1992 | Accorsi et al. | 14/73 |
| 5,144,710 | 9/1992 | Grossman | 14/73 |

*Primary Examiner*—William P. Neuder
*Attorney, Agent, or Firm*—Marshall, O'Toole, Gerstein, Murray & Borun

[57] ABSTRACT

An overpass bridge that can be used to replace an existing bridge and provide increased clearance over an existing roadway includes two opposed reinforced concrete edge beams positioned above and on either side of the deck surface. The inside wall of each edge beam is configured as parapet wall. The edge beams and the deck slab are post-tensioned with longitudinal tendons anchored at each end of the bridge. The bridge is built using an aligned series of precast concrete segments extending between the bridge abutments. Each segment has a set of transverse tendons extending from lower portions of one edge beam, through the deck slab, to a lower portion of the opposite edge beam. The bridge can be built in a step-by-step process. First, the segments are precast and longitudinal erection beams are extended between the abutments on which the bridge is to be built. The superstructure segments are transported across longitudinal erection beams to their final positions. When all the segments are in place, longitudinal tendons are installed through the segments, post-tensioned, and anchored at each end in proximity to the abutments. The erection beams are then removed and a wearing surface can be applied.

16 Claims, 5 Drawing Sheets

CHANNEL BRIDGE

TECHNICAL FIELD

This invention relates generally to vehicular overpass bridges and more particularly to short-span overpass bridges made of precast concrete segments.

BACKGROUND ART

Many or most of the short-span overpass bridges in the United States are constructed of a deck surface on top of a supporting structure, most commonly a framework of steel or concrete I-beams. For example, a conventional four-span, two-lane overpass bridge built in the late 1940's across a four-lane divided highway (a total span of approximately 215 feet) could have a 3" pavement wearing surface on a 7" structural slab of reinforced concrete supported on top of a framing system consisting of five longitudinal 33" deep steel I-beams.

One relatively new example of a bridge design using a deck surface on top of a supporting structure can be found in Barnoff et al., U.S. Pat. No. 4,604,841, in which a deck surface takes the form of precast, prestressed concrete form panels that are supported by floor beams. In one illustration in the patent, the floor beams have the form of conventional I-beams. Another example of a bridge design using a deck surface on top of a supporting structure can be found in Schupack, U.S. Pat. No. 3,794,433, in which the deck surface rests on top of concrete, open-topped box beams. Similarly, Hewett, U.S. Pat. No. 890,769 discloses a bridge in which a deck surface is supported on top of integral concrete ribs.

All of these designs have a relatively thick profile between the top of the deck surface and the bottom of the supporting structure. This thickness limits the clearance below the bridge, which, in overpass bridges, can be extremely important. In many instances in the U.S., when existing bridges need to be replaced because of deterioration or no longer meeting applicable highway standards, it may be necessary, based on applicable highway standards, to provide a new bridge with greater clearance. It is not uncommon for engineers to obtain greater clearance in a replacement bridge by simply raising the grade of the roadway approaching the bridge. Such a solution is expensive and inconvenient, particularly if other structures are already present in the area.

There is believed to be a significant need in the U.S. for a bridge that offers higher clearance over existing roadways without the need to raise the grade of the roadway approaching the bridge, and that can be built not only at a competitive cost, but also with a minimal disruption of traffic on the roadway below.

It has been known that prefabrication of bridge elements is advantageous. Thus, for example, Slaw, Sr., U.S. Pat. No. 4,972,537, discloses a composite prefabricated deck panel that may be used in bridges or buildings. The composite panel consists of a concrete slab poured over the top flanges of a series of I-beams. As another example, Richard, U.S. Pat. No. 4,625,354, discloses a two-deck bridge made of prefabricated sections that are stressed by cables that pass through the hollow interiors between the structural walls of each section. While the advantages of using prefabricated segments have been known, it is believed that it has not been known how to apply these principals to the problem of increasing the clearance under a short-span overpass bridge.

SUMMARY OF THE INVENTION

The invention disclosed and claimed in this application provides a short-span overpass bridge with increased clearance.

The deck slab of the bridge is supported not by an underlying support structure, but rather by two opposed reinforced concrete edge beams positioned above and on either side of the deck surface, the inside wall of each beam being configured as parapet wall. For strength, each edge beam and the deck slab itself are post-tensioned with a set of longitudinal tendons anchored at either end of the bridge. By eliminating the underlying support structure, clearance under the bridge is increased significantly.

Such a bridge can be efficiently built using an aligned series of precast concrete superstructure segments extending between the bridge abutments. In each of the segments, a longitudinal portion of each of the opposed edge beams is integral with a longitudinal portion of the deck slab. Each superstructure segment has a set of post-tensioned transverse tendons extending though lower portions of each edge beam portion and through the deck slab portion.

BRIEF DESCRIPTION OF THE DRAWINGS

Further advantages of the invention will become apparent upon reading the following detailed description of the invention in conjunction with the accompanying drawings, in which.

DESCRIPTION OF THE PREFERRED EMBODIMENT

Figure 1:
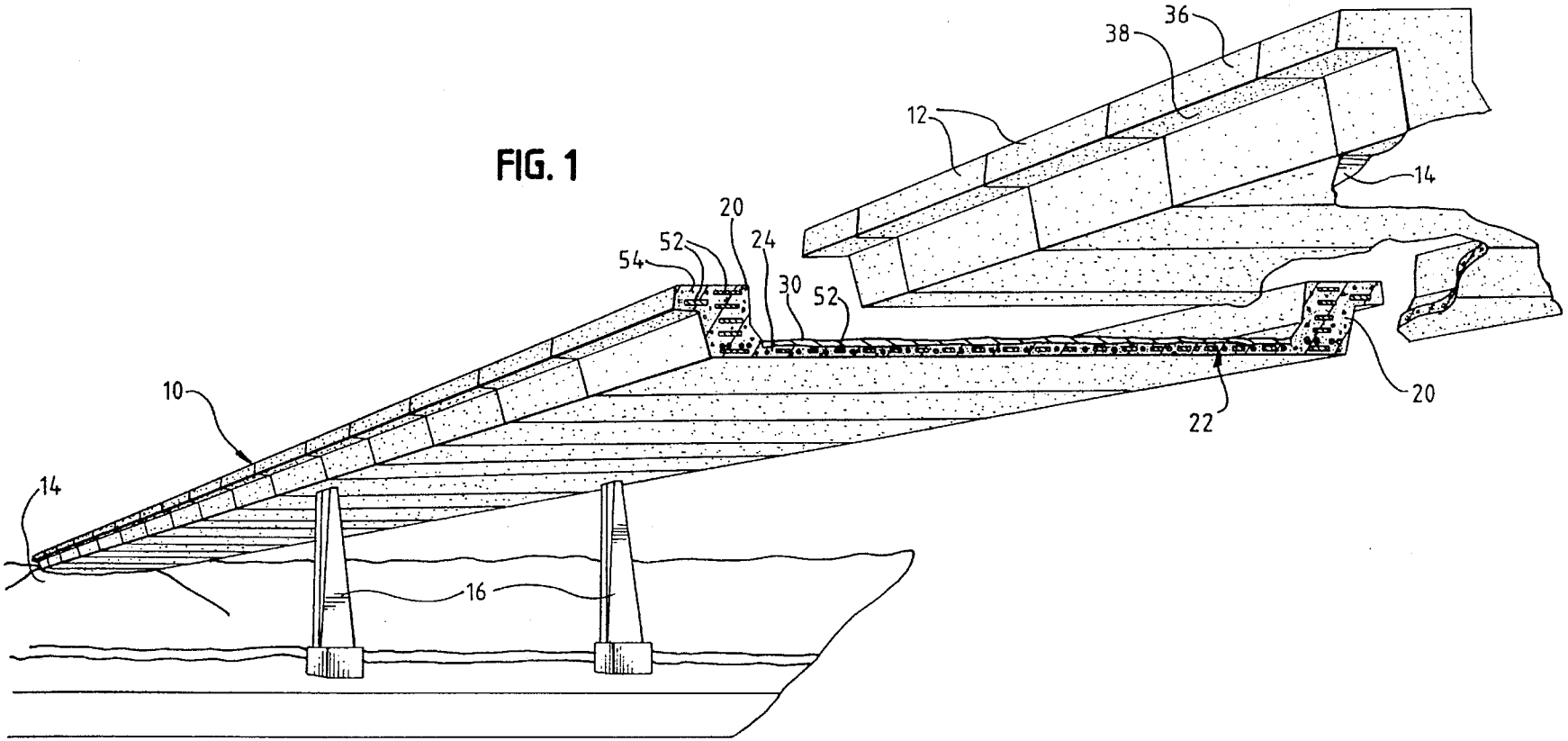
FIG. 1 is a fragmentary perspective of one embodiment of a bridge in accordance with the present invention.

The bridge 10 shown in FIG. 1 is constructed of twenty-three aligned superstructure segments 12 extending between bridge abutments 14 and over central piers 16. The superstructure segments over the abutments are each 6' long, while the other twenty-one superstructure segments are each 9'8" long, providing a total deck span of 215'. For longer or shorter bridges, the number of segments or the length of the segments could be increased or decreased. The illustrated bridge 10, which is approximately 43' wide and 4'7" high, but could be of different widths or heights, has two opposed reinforced concrete edge beams 20 positioned above and on either side of a deck surface 22. The height of the edge beams 20 in the illustrated bridge 10 thus provides a span-to-depth ratio of approximately 23:1. The dimensions could be obviously altered to provide different span-to-depth ratios. The deck surface, which is 32' wide but, again, could be wider or narrower, includes a reinforced concrete deck slab 24 covered by, but not necessarily requiring, an overlying wearing pavement 30. The deck slab 24 varies in thickness from about 9" adjacent the edge beams 20 to about 1' at the centerline of the bridge. The wearing pavement 30 is approximately 2½" thick.

Figure 2:
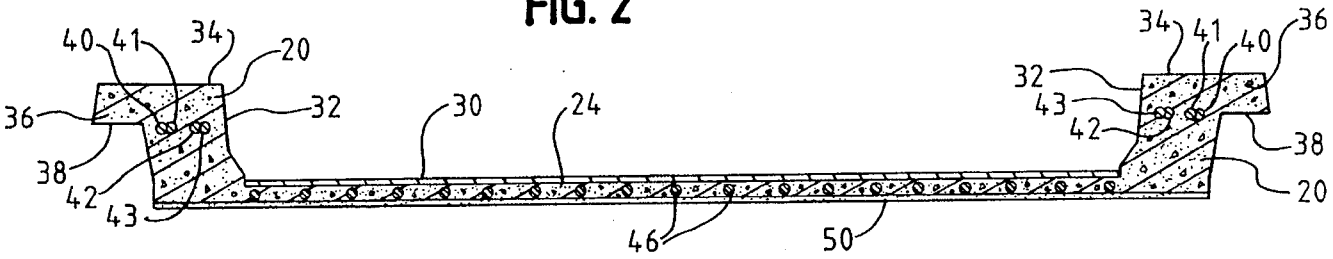
FIG. 2 is a typical cross-sectional view of a superstructure segment of the bridge shown in FIG. 1.

As seen in FIG. 2, the inside wall of each edge beam 20 is configured as a parapet wall 32. In the illustrated bridge 10, the inside wall of each edge beam 20 rises approximately 3½' above the wearing pavement 30. The top walls 34 of the illustrated edge beams 20 are approximately 4½', wide and form parts of flanges 36 that extend outwardly from the top of the edge beams. The illustrated flanges 36 are approximately 1½' high, and have lower walls 38 that are approximately 1'10" wide. The flanges 36 can be used during construction and give the illustrated bridge 10 improved torsional rigidity under traffic conditions. Below the flanges 36, the illustrated edge beams 20 are approximately 3' wide.

Figure 3:
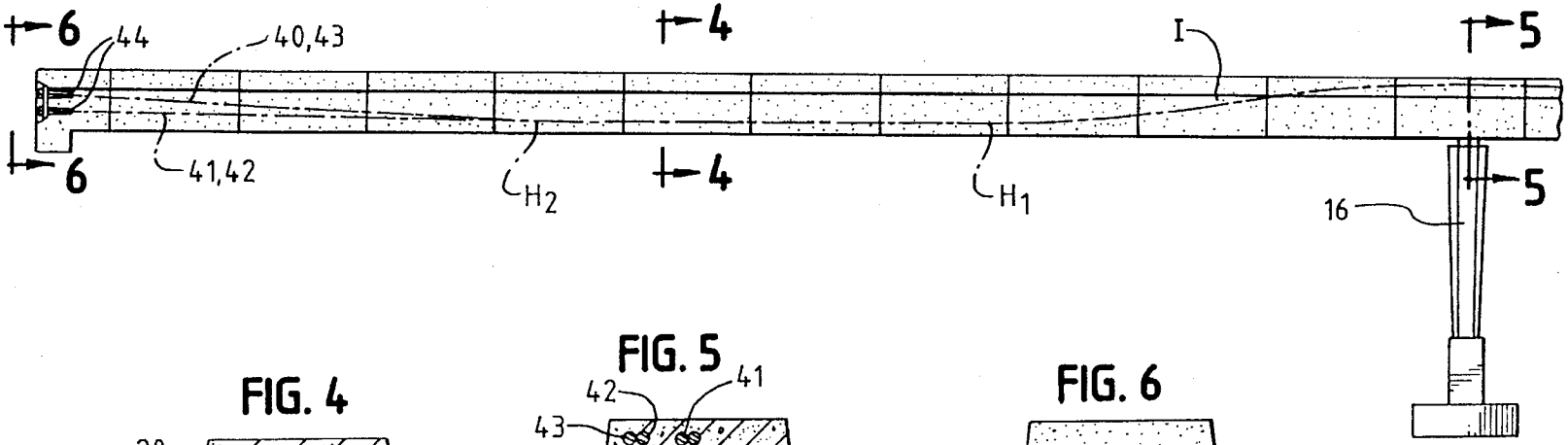
FIG. 3 is a diagrammatic view of the positions of some of the longitudinal tendons in a portion of the bridge shown in FIG. 1.

Each of the illustrated edge beams 20 is post-tensioned with four longitudinal tendons 40–43. Each such tendon is made of nineteen 0.6" diameter steel strands each having an ultimate stress of 270 ksi. The number, composition, or size of the tendons could be varied. The illustrated longitudinal tendons 40–43 extend the full length of the bridge 10, and are draped in the configuration shown in dot-dash lines in FIG. 3. The illustrated draped configuration of the longitudinal tendons 40–43 has a downward curve centered on the centerline of the piers 16 with a radius of approximately 105'. At an inflection point I approximately eighteen feet from the centerline of the piers 16, the draped configuration of the tendons begins an upward curve with approximately the same 105' radius. From a point $H_1$ about thirty-six feet frown the centerline of the piers 16 to a point $H_2$ about seventy feet from the centerline of the piers 16, the tendons 40–43 extend horizontally. Thereafter, the tendons 40–43 extend in straight lines to anchor points above the abutments 14.

Figure 6:
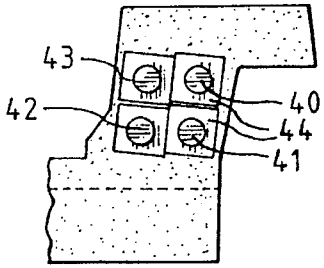
FIG. 6 is a partial sectional view taken through line 6—6 of FIG. 3.
Figure 5:
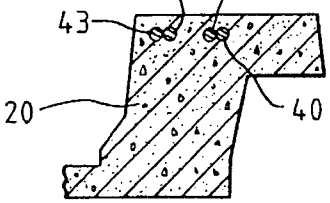
FIG. 5 is a partial sectional view taken through line 5—5 of FIG. 3.
Figure 4:
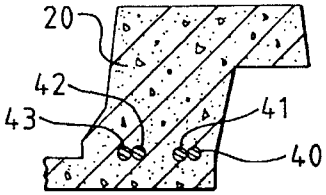
FIG. 4 is a partial sectional view taken through line 4—4 of FIG. 3.

When the longitudinal tendons 40–43 pass through the segment 12 shown in FIG. 4, they are positioned in two groups approximately 8" apart and approximately 11" from the bottom of the edge beam 20. When these tendons 40–43 pass above the piers 16, as seen in FIG. 5, they are positioned in two groups approximately 8" apart and approximately 4'1" from the bottom of the edge beam 20. Over the abutments 14, seen in FIG. 6, these longitudinal tendons 40–43 are terminated at post-tensioning anchorages 44 with tendons 41 and 42 positioned about 6" above the position shown in FIG. 4 and tendons 40 and 43 positioned about 2'9" above the position shown in FIG. 4. (In comparing FIG. 6 with FIGS. 4 or 5, it may be noted that the superstructure segments 12 over the abutments 14 can have a greater height than the other superstructure segments. This is seen more clearly in FIG. 3.) The draped configuration of these longitudinal tendons could be varied.

As seen in FIG. 2, the illustrated bridge 10 also includes eighteen longitudinal tendons 46 extending through the deck slab 24. These deck slab tendons 46 are each made of seven strands of the same material used to make the longitudinal tendons 40–43 that pass through the edge beams 20. The deck slab tendons 46 are spaced at 1'9" centers approximately 4" below the top of the deck slab 24. The deck slab tendons 46 extend the full length of the bridge 10 and, like the other longitudinal tendons 40–43, are anchored in the superstructure segments above the abutments 14. The number, composition, or positioning of these deck slab tendons also could be varied.

Each superstructure segment 12 has a set of transverse tendons 50 extending through lower portions of each edge beam 20 and through the deck slab 24, as seen in FIG. 2. These transverse tendons 50 are monostrands of the same material used to for the other tendons 40–43 and 46, and are positioned approximately 3½" above the bottom of the deck slab 24. These transverse tendons 50 are positioned at 6" intervals across the length of each superstructure segment 12, with the first and last transverse tendon in each segment being positioned approximately 4" from the transverse face 54 of the segment. Thus, each of the superstructure segments 12 between the abutments 14 has eighteen transverse tendons 50. The superstructure segments over the abutments each have six transverse tendons. The number, composition, and positioning of the transverse tendons 50 could be varied. Post-tensioning of the transverse tendons 50 at the factory provides the strength necessary to support the thin superstructure segments 12 as they are transported to the construction site.

In the illustrated bridge 10, all the superstructure segments 12 between the abutments 14 have the same physical geometry. Benefits of the present invention could be obtained using segments with different geometries. However, use of segments 12 with the same geometry minimizes the costs of preparing the forms to be used in prefabricating the segments. The cost of preparing forms can range from $20,000–70,000 or more. When several bridges are to be built, it may be possible to satisfy the load requirements of different bridges using superstructure segments 12 with the same segment geometry by merely changing the number or positioning of the longitudinal tendons 40–43 through the edge beams 20. If the same forms can be used, it is believed there can be a cost savings of an estimated 15–20% over conventional construction. The same forms can be used even if the number and positioning of the longitudinal tendons 40–43 varies. This is because the number and positioning of the longitudinal tendons 40–43 is provided by ducts placed in the forms, not by the forms themselves. Thus, the number or positioning of the longitudinal tendons 40–43 within the superstructure segments 12 can be changed without incurring an additional cost for preparing new forms.

Each superstructure segment 12 in the illustrated bridge 10 is formed with shear keys 52 on its transverse faces 54, as seen in FIG. 1. These shear keys cooperate with mating keys on adjacent superstructure segments 12 to provide additional shear resistance. To provide as precise a fit as possible, each superstructure segment 12 (with the exception of the first end segment) can be match cast using a transverse face 54 of an already molded superstructure segment (covered with a thin layer of wax or the like) as the form for an adjoining transverse face between the two segments. Thus, any irregularities in the transverse face 54 of one superstructure segment 12 are matched in the adjoining transverse face of an adjacent superstructure segment.

Figure 7:
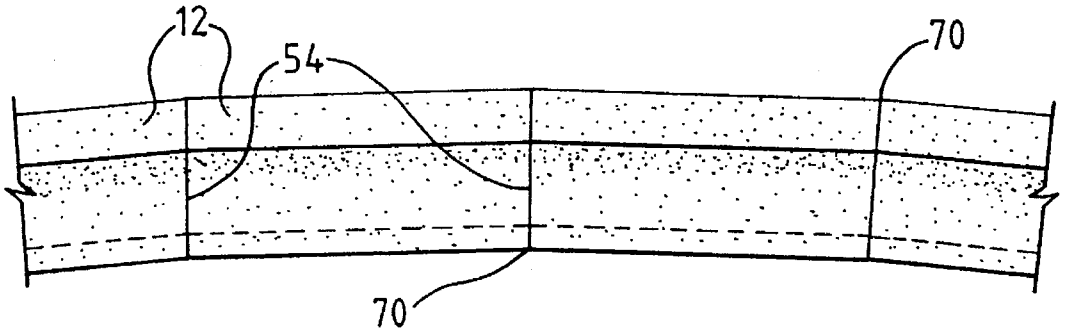
FIG. 7 is an exaggerated side view of consecutive segments used to construct the bridge shown in FIG. 1.

As seen in exaggerated from in FIG. 7, the superstructure segments 12 used in the illustrated bridge 10 are molded so that the opposed transverse faces 54 deviate slightly from the vertical. This arrangement of the transverse faces 54 provides a curvature of the bridge 10. Increasing or decreasing the deviation from the vertical increases or decreases the amount of curvature of the bridge.

Because of the relative thinness of the deck surface 22, the bridge 10 illustrated in fig. 1, when used to replace the conventional 1940's style bridge described in the background section above, results in an increased clearance of approximately 2'10", without changing the grade of the approaching roadway.

Figure 8:
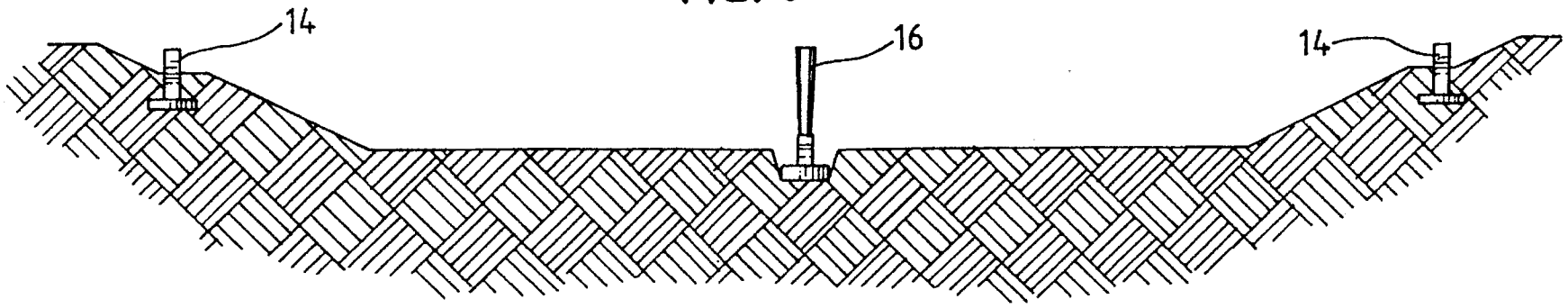
FIG. 8 is a diagrammatic view of the substructure used to build the bridge.
Figure 10:
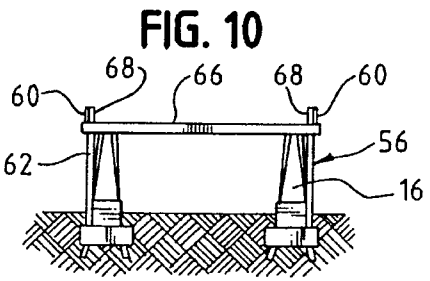
FIG. 10 is a sectional view through lines 10—10 of FIG. 9.
Figure 11:
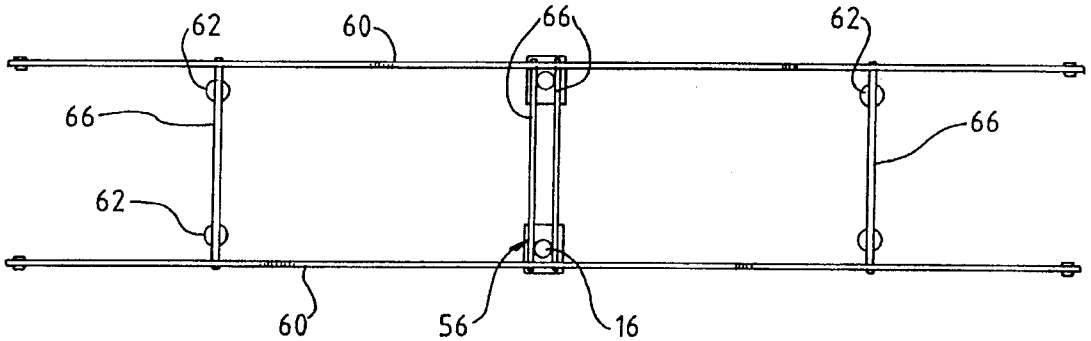
FIG. 11 is a top view of the substructure and temporary framework shown in FIG. 10.
Figure 9:
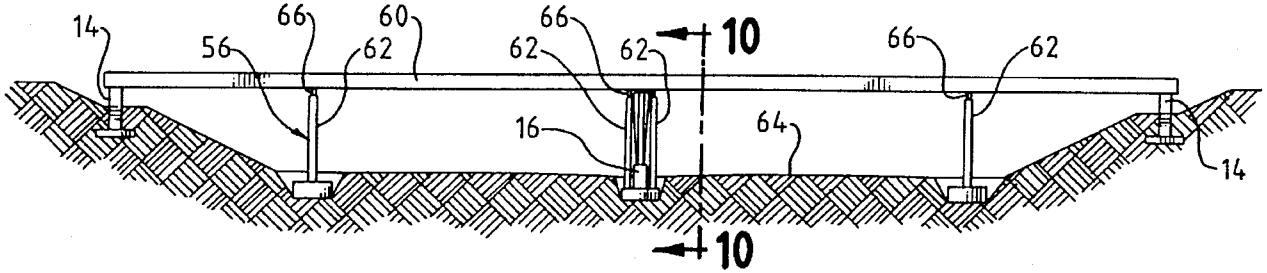
FIG. 9 is a diagrammatic view of the substructure with a temporary framework for building the bridge.

The illustrated bridge 10 can be built quickly and easily. If the bridge is replacing an existing bridge, it may be possible to use abutments or other substructure of the existing bridge as part of the substructure of the replacement bridge. Otherwise, a conventional substructure can be built, for example, including abutments 14 and piers 16, as seen in FIG. 8. The geometry of the central piers 16 shown here is ornamental, providing desirable aesthetic qualities to the completed bridge. Next, as seen in FIGS. 9–11, a temporary steel framework is built around the substructure to support a set of parallel erection beams 60 so that the upper surfaces 68 of the erection beams (seen in FIG. 10) roughly correspond with the desired final position of the edge beams 20. In the example illustrated in FIGS. 9, 10, and 11, a temporary steel framework 56 includes sets of temporary piers 62 set on opposite sides of the underlying roadway 64 and adjacent the central piers 16. These temporary piers 62 are crossed by temporary beams 66 parallel to the underlying roadway. The arrangement and positioning of the framework supporting the erection beams 60 could be varied, of course.

Figure 12:
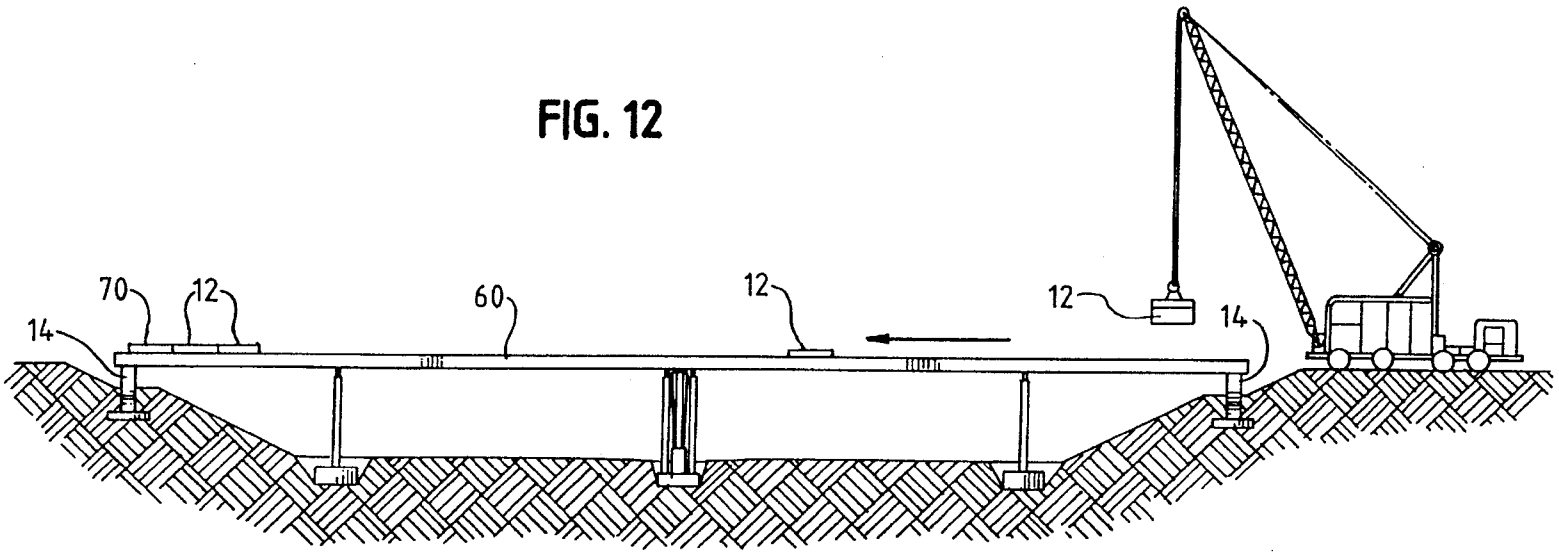
FIG. 12 is a diagrammatic view showing superstructure segments being loaded on the temporary framework shown in FIGS. 9–11.
Figure 13:
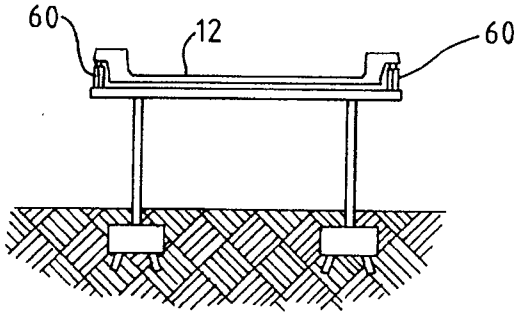
FIG. 13 is a sectional view through lines 13—13 of FIG. 12.

FIGS. 12 and 13 illustrate one way to position the superstructure segments 12. After one of the end superstructure segments 12 has been placed over one of the abutments 14, the remaining superstructure segments 12 are brought to a loading location, seen in FIG. 12, adjacent the opposite abutment. The erection beams 60 are then used to transport the segments to their final positions. It is preferred to transport the segments 12 across the erection beams 60 in pairs, in order to avoid crabbing of the segments 12 between the beams 60. As the segments 12 reach their final positions, epoxy is applied to match cast joints 70 (identified in FIG. 7) on the transverse faces 54 to be joined together. The segments 12 are then pulled together with temporary post-tensioning to assure proper distribution of the epoxy, as is well-known in the art. The segments 12 of the illustrated bridge 10 can be unloaded and placed all in a single day, without any disruption of traffic on the roadway below.

When all the superstructure segments 12 are in place, the longitudinal tendons 40–43 and 46 are installed and stressed. While all the longitudinal tendons 40–43 and 46 of the illustrated bridge 10 extend the full length of the bridge, in other designs some longitudinal tendons could be stopped off part way through the bridge. After the tendons 40–43 and 46 are installed and stressed, the post-tensioning ducts 44 are grouted using conventional techniques.

Finally, the erection beams 60 and temporary framework 56 are removed and the wearing pavement 30 can be applied, if necessary, to complete the deck surface 22. It is only during the erection and removal of the temporary framework 56 and erection beams 60 that traffic needs to be disrupted on the underlying roadway.

This method allows the illustrated bridge 10 to be built in about one week on site. Construction of a conventional bridge on the same site would generally require about four or five weeks on site.

While one embodiment of the invention has been illustrated and described in detail, it should be understood this embodiment can be modified and varied without departing from the scope of the following claims.

I claim:

1. An overpass bridge comprising:

two abutments;

an aligned series of monolithic precast concrete superstructure segments extending between the abutments. each superstructure segment comprising longitudinal portions of two opposed edge beams; a longitudinal portion of a deck slab extending between lower parts of the longitudinal portions of the edge beams; and two opposed parapet walls formed on the longitudinal portions of the edge beams, above the deck slab portion;

at least one set of longitudinal post-tensioned tendons extending through an edge beam and being anchored at each end of the bridge in proximity to the abutments; and a road surface over the aligned deck slab portions.

2. The overpass bridge of claim 1, in which the superstructure segments further comprise flanges formed on and extending outwardly from upper parts of the longitudinal portions of the edge beams.

3. The overpass bridge of claim 1, in which adjoining transverse faces of the superstructure segments include shear keys.

4. The overpass bridge of claim 1, in which the superstructure segments further comprise post-tensioned longitudinal tendons in the longitudinal portions of the deck slab.

5. The overpass bridge of claim 1, in which all of the superstructure segments between the abutments have the same physical geometry.

6. The overpass bridge of claim 1, further comprising sets of longitudinal post-tensioned tendons extending through the edge beams.

7. The overpass bridge of claim 1, in which:

the superstructure segments further comprise a set of post-tensioned transverse tendons extending through the longitudinal portion of the deck slab and lower parts of the longitudinal portions of the edge beams.

8. The overpass bridge of claim 1, in which the deck surface is no more than about 1½' thick.

9. The overpass bridge of claim 1, in which:

the superstructure segments further comprise flanges formed on and extending outwardly from upper parts of longitudinal portions of the edge beams, shear keys on a transverse face, post-tensioned longitudinal tendons in the longitudinal portions of the deck slab, and a set of post-tensioned transverse tendons extending through the longitudinal portion of the deck slab and lower parts of the longitudinal portions of the edge beams;

all the superstructure segments between the abutments have the same physical geometry;

the bridge further comprises sets of longitudinal post-tensioned tendons extending through the edge beams; and the deck surface is no more than about 1½' thick.

10. A monolithic precast concrete superstructure segment useful for constructing an overpass bridge, the superstructure segment comprising:

longitudinal portions of two opposed edge beams;

a longitudinal portion of a deck slab extending between lower parts of the longitudinal portions of the edge beams;

shear keys on transverse faces of the segments;

a set of post-tensioned transverse tendons extending through the longitudinal portion of the deck slab and lower parts of the longitudinal portions of the edge beams; and two opposed parapet walls formed on the longitudinal portions of the edge beams, above the longitudinal portion of the deck slab.

11. The superstructure segment of claim 10, further comprising ducts for longitudinal tendons in the longitudinal portions of the edge beams.

12. The superstructure segment of claim 10, further comprising ducts for longitudinal tendons in both the longitudinal portions of the edge beams and the longitudinal portion of the deck slab.

13. The superstructure segment of claim 10, further comprising flanges formed on and extending outwardly from an upper part of each of the longitudinal portions of the edge beams.

14. The superstructure segment of claim 10, in which the deck surface is no more than about 1½' thick.

15. The superstructure segment of claim 10, further comprising ducts for longitudinal tendons in both the longitudinal portions of the edge beams and the longitudinal portion of the deck slab, and flanges formed on and extending outwardly from upper parts of the longitudinal portions of the edge beams.

16. A method for increasing the clearance over a roadway passing under an existing bridge deck supported by floor beams, the method comprising the steps of:

removing the existing bridge deck and floor beams;

building a temporary framework including two opposed longitudinal erection beams extending between two abutments, the erection beams having spaced longitudinal surfaces; and precasting a set of monolithic concrete superstructure segments, all of the superstructure segments between the abutments having the same physical geometry and comprising: longitudinal portions of two opposed edge beams; a longitudinal portion of a deck slab extending between lower parts of the longitudinal portions of the edge beams; two opposed parapet walls formed on longitudinal portions of the edge beams, above the longitudinal portion of the deck slab; flanges extending outwardly from upper parts of the longitudinal portions of the edge beams; ducts for longitudinal tendons in the longitudinal portions of the edge beams and in the longitudinal portions of the deck slab; and shear keys molded on transverse faces of the segment, a transverse face of another segment being used as the form for all adjoining face between the two segments;

transporting the superstructure segments across the erection beams to their final positions and pulling adjacent segments together with temporary post-tensioning to create two opposed load-bearing edge beams and a deck slab;

extending longitudinal tendons through the edge beams and the deck slab; post-tensioning the longitudinal tendons; and anchoring the longitudinal tendons at each end of the bridge in proximity to the abutments; and removing the temporary framework and applying a road surface over the deck slab to form a deck surface extending between lower parts of the edge beams at a height above the roadway approximately equal to the height at which the removed bridge deck existed, the thickness of the deck surface in the replacement bridge being less than the combined thickness of the removed bridge deck and floor beams.

* * * * *

UNITED STATES PATENT AND TRADEMARK OFFICE

CERTIFICATE OF CORRECTION

PATENT NO. : 5,577,284
DATED : November 26, 1996
INVENTOR(S) : Jean Muller

It is certified that error appears in the above-identified patent and that said Letters Patent is hereby corrected as shown below:

Information disclosure statement, U.S. patent, the date of the "Richard" patent should be "12/1986, not 1985.

Column 3,
Line 22, delete the "," after "4½"
Line 44, "frown" -- should be -- "from"

Column 4,
Line 65, "from -- should be -- "form"

Signed and Sealed this

Eleventh Day of December, 2001

*Attest:*

Nicholas P. Godici

*Attesting Officer*

NICHOLAS P. GODICI
*Acting Director of the United States Patent and Trademark Office*